US011030933B1

(12) United States Patent
Chuang

(10) Patent No.: US 11,030,933 B1
(45) Date of Patent: Jun. 8, 2021

(54) SUB-PIXEL RENDERING METHOD AND DISPLAY DEVICE

(71) Applicant: HIMAX TECHNOLOGIES LIMITED, Tainan (TW)

(72) Inventor: Chi-Feng Chuang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/706,777

(22) Filed: Dec. 8, 2019

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 2310/027* (2013.01)

(58) Field of Classification Search
None
See application file for complete search history.

(56) References Cited

U.S. PATENT DOCUMENTS

2016/0148579 A1* 5/2016 Kimura ..... G09G 3/3607 345/694
2018/0190239 A1* 7/2018 Zhu ..... H04N 9/64
2018/0259824 A1* 9/2018 Bouchard ..... G09G 3/2048

* cited by examiner

*Primary Examiner* — Stephen T. Reed
(74) *Attorney, Agent, or Firm* — CKC & Partners Co., LLC

(57) ABSTRACT

A sub-pixel rendering method includes: obtaining a digital image, in which the number of grey levels in the digital image is greater than a number of sub-pixel structures of a display panel; determining if each grey level is in a dark-on-bright texture; transforming the grey levels into sub-pixel luminances; performing a filter operation on the sub-pixel luminances according to a rendering mask to calculate rendered sub-pixel luminances, in which a weight of the rendering mask is increased if the corresponding sub-pixel luminance is in the dark-on-bright texture; transforming the rendered sub-pixel luminances into rendered grey levels, and driving the display panel according to the rendered grey levels.

10 Claims, 11 Drawing Sheets

SUB-PIXEL RENDERING METHOD AND DISPLAY DEVICE

BACKGROUND

Field of Invention

The present invention relates to a method and a display device of performing a sub-pixel rendering algorithm to deal with a texture where dark patterns are shown on bright background.

Description of Related Art

In a conventional display panel, multiple sub-pixel structures are arranged as a matrix, and each sub-pixel structure renders one of red, green, and blue colors, and three sub-pixel structures of red, green, and blue constitute a pixel. However, in some panels, one pixel only includes two sub-pixel structures. For example, one pixel may only include one red sub-pixel structure and one green sub-pixel structure, and another pixel may only include one green sub-pixel structure and one blue sub-pixel structure. It is an issue in the art about how to correctly render a digital image in this kind of panels.

SUMMARY

Embodiments of the present disclosure provide a sub-pixel rendering method for a display panel including sub-pixel structures. The sub-pixel rendering method includes: obtaining a digital image including pixels, in which each of the pixels includes grey levels, and a number of the grey levels in the digital image is greater than a number of the sub-pixel structures; for each of the grey levels, determining if the grey level is in a dark-on-bright texture; transforming the grey levels into sub-pixel luminances; performing a filter operation on the sub-pixel luminances according to a rendering mask to calculate rendered sub-pixel luminances, in which the rendering mask includes weights, each of the weights corresponds to one of the sub-pixel luminances, and one of the weights is increased if the corresponding sub-pixel luminance is in the dark-on-bright texture; transforming the rendered sub-pixel luminances into rendered grey levels, in which a number of the rendered grey levels is equal to the number of the sub-pixel structures; and driving the display panel according to the rendered grey levels.

In some embodiments, the step of determining if the grey level is in the dark-on-bright texture includes: obtaining first grey levels from the grey levels that have same colors according to a texture mask; determining a number of the first grey levels that are smaller than a first threshold; and determining that a center grey level in the texture mask is in the dark-on-bright texture if the number of the first grey levels that are smaller than the first threshold is less than a second threshold.

In some embodiments, the method further includes: calculating a mean and a variance of the first grey levels; and subtracting N times of the variance from the mean as the first threshold, in which N is a positive real number.

In some embodiments, the step of transforming the grey levels into the sub-pixel luminances includes: performing a gamma transformation to each of the grey levels to obtain a corresponding one of the sub-pixel luminances.

In some embodiments, after the one of the weights is increased, the sub-pixel rendering method further includes: normalizing the weights of the rendering mask such that a sum of the weights is equal to 1.

In some embodiments, the sub-pixel luminances corresponding to the rendering mask have same colors.

From another aspect, a display device includes a display panel including sub-pixel structures and a computation circuit configured to obtain a digital image including pixels. Each of the pixels includes grey levels, and a number of the grey levels in the digital image is greater than a number of the sub-pixel structures. The computation circuit is further configured to: for each of the grey levels, determine if the grey level is in a dark-on-bright texture; transform the grey levels into sub-pixel luminances; perform a filter operation on the sub-pixel luminances according to a rendering mask to calculate rendered sub-pixel luminances, in which the rendering mask includes weights, each of the weights corresponds to one of the sub-pixel luminances, and one of the weights is increased if the corresponding sub-pixel luminance is in the dark-on-bright texture; transform the rendered sub-pixel luminances into rendered grey levels, in which a number of the rendered grey levels is equal to the number of the sub-pixel structures; and drive the display panel according to the rendered grey levels.

In some embodiments, the computation circuit is further configured to: obtain first grey levels from the grey levels that have same colors according to a texture mask; determine a number of the first grey levels that are smaller than a first threshold; and determine that a center grey level in the texture mask is in the dark-on-bright texture if the number of the first grey levels that are smaller than the first threshold is less than a second threshold.

In some embodiments, the computation circuit is further configured to: calculate a mean and a variance of the first grey levels; and subtract N times of the variance from the mean as the first threshold, in which N is a positive real number.

In some embodiments, the computation circuit is further configured to: perform a gamma transformation to each of the grey levels to obtain a corresponding one of the sub-pixel luminances.

In some embodiments, the computation circuit is further configured to: normalize the weights of the rendering mask such that a sum of the weights is equal to 1.

In some embodiments, the sub-pixel luminances corresponding to the rendering mask have same colors.

BRIEF DESCRIPTION OF THE DRAWINGS

The invention can be more fully understood by reading the following detailed description of the embodiment, with reference made to the accompanying drawings as follows.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size.

The using of "first", "second", "third", etc. in the specification should be understood for identifying units or data described by the same terminology, but are not referred to particular order or sequence.

Figure 1:
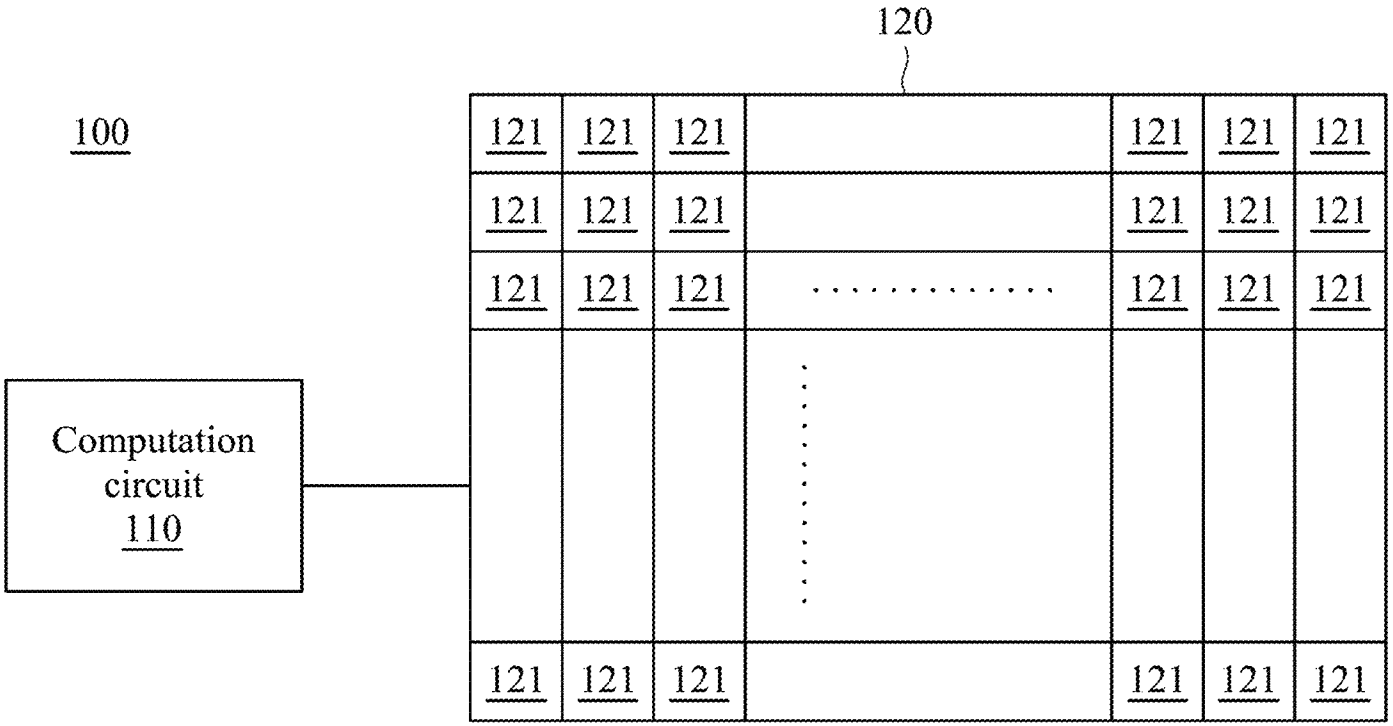
FIG. 1 is a schematic diagram of a display device in accordance with an embodiment.

FIG. 1 is a schematic diagram illustrating a display device in accordance with an embodiment. Referring to FIG. 1, a display device 100 includes a computation circuit 110 and a display panel 120. The computation circuit 110 obtains a digital image and generates grey levels for the display panel 120. The computation circuit 110 may be a timing controller, a digital image processor, an application-specific integrated circuit, or any suitable circuit disposed in the display device 100. The display panel 120 includes multiple sub-pixel structures 121. The display panel 120 may be a liquid crystal display panel or an organic light emitting display panel, which is not limited in the invention.

The digital image obtained by the computation circuit 110 includes multiple pixels. Each pixel includes multiple grey levels, and each grey level corresponds to one of colors which may include red, green, and blue. Each sub-pixel structure 121 also corresponds to one of the colors. In particular, different from a conventional display device in which one pixel corresponds to three sub-pixel structures, one pixel corresponds to two or less sub-pixel structures in this embodiment. For example, if the digital image has M rows and N columns where M and N are positive integers, then there are M×N×3 sub-pixel structures in the conventional display panel, but there are M×N×2 sub-pixel structures in this embodiment. In other words, the number of the grey levels in the digital image is greater than the number of the sub-pixel structures 121 because each pixel of the digital image includes three grey levels and each pixel only corresponds to two of the sub-pixel structures 121.

Figure 2A:
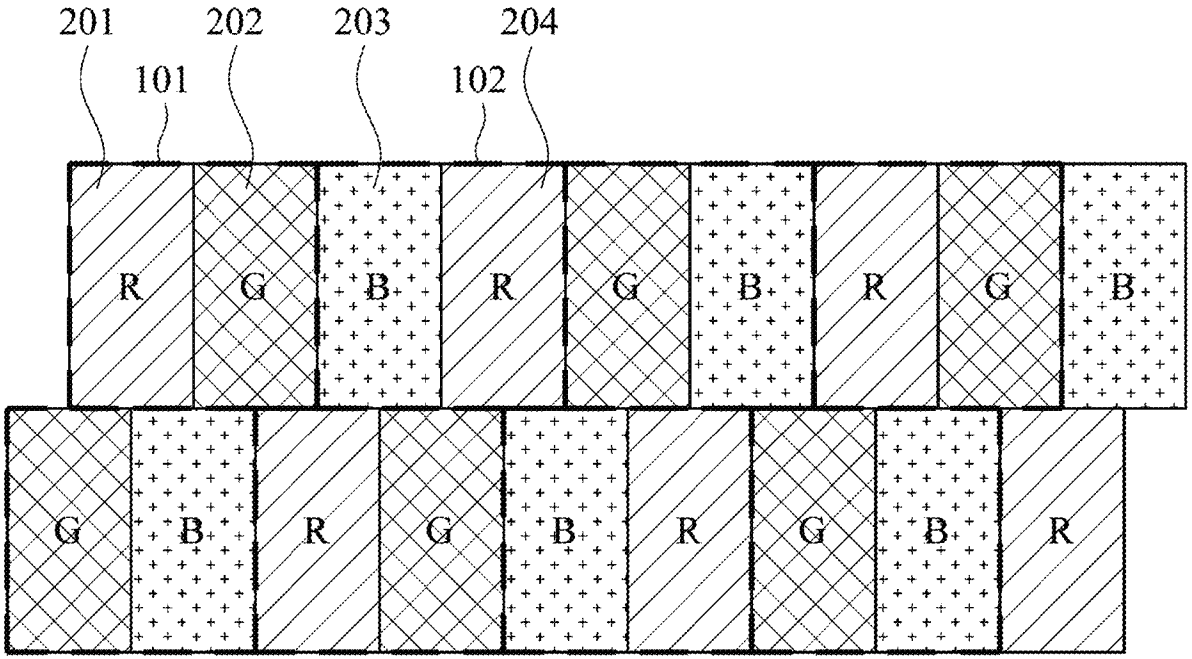
FIG. 2A to FIG. 2F are schematic diagrams illustrating colors of the sub-pixel structures in the display panel in accordance with some embodiments.
Figure 2B:
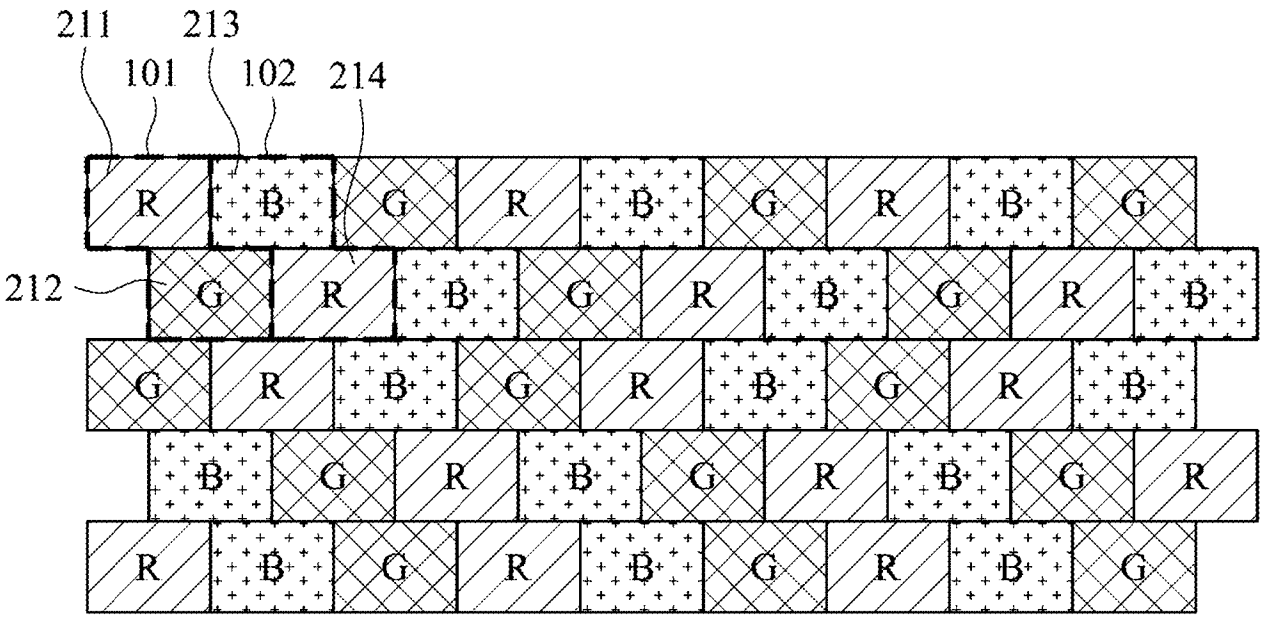
Figure 2C:
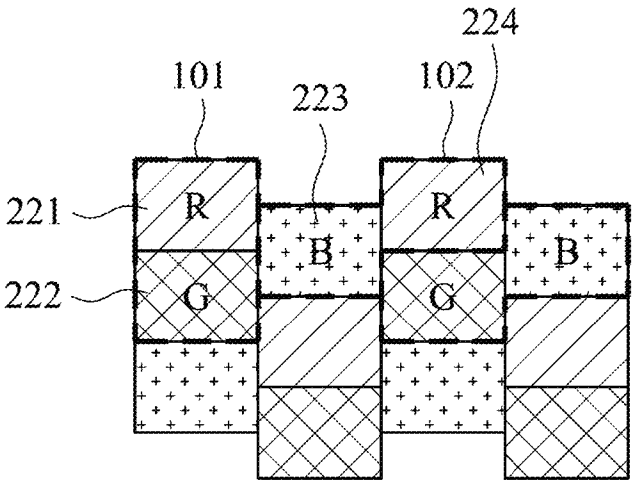
Figure 2D:
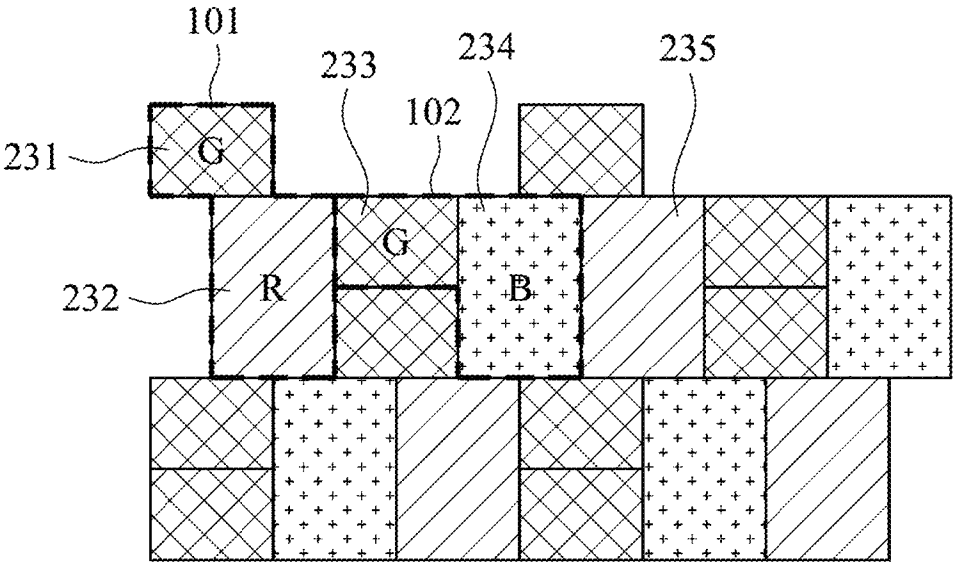
Figure 2E:
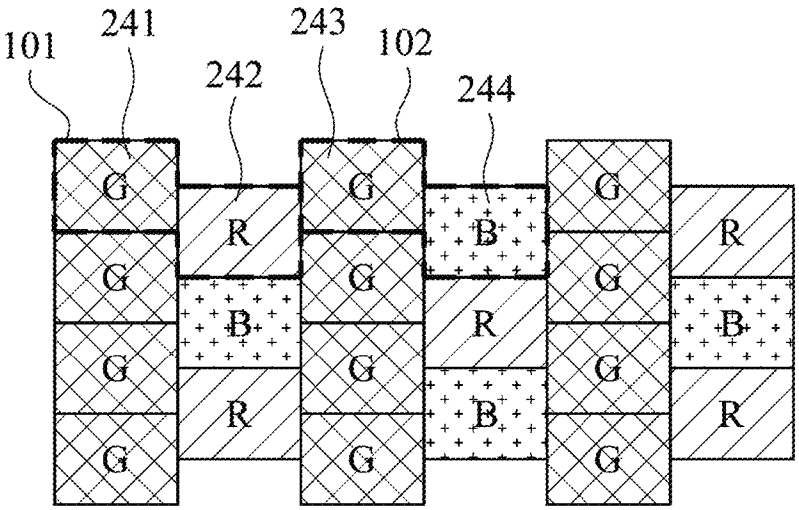
Figure 2F:
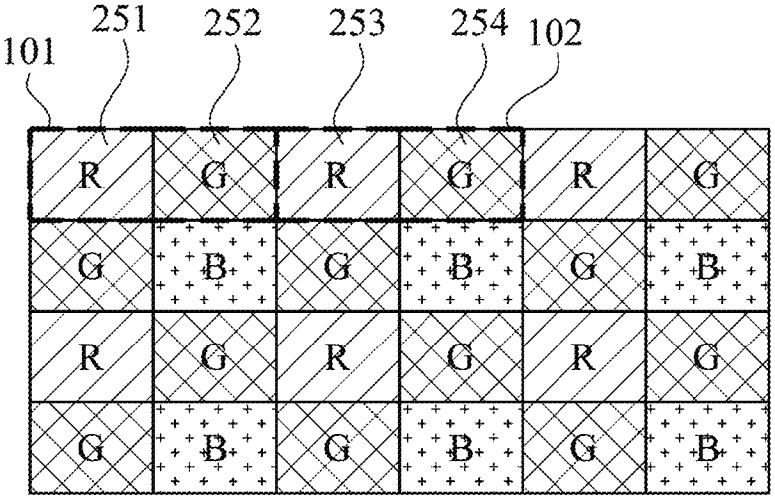

FIG. 2A to FIG. 2F are schematic diagrams illustrating colors of the sub-pixel structures in the display panel in accordance with some embodiments. In the embodiments of FIG. 2A to FIG. 2E, only colors and relative positions of the sub-pixel structures are shown for simplification, in which R, G, and B represent red, green, and blue respectively. Two sub-pixel structures surrounded by dash lines correspond to the same pixel. For example, in FIG. 2A, red and green sub-pixel structures 201, 202 correspond to a pixel 101, and blue and red sub-pixel structures 203, 204 correspond to a pixel 102. In the embodiment of FIG. 2B, red and blue sub-pixel structures 211, 212 correspond to the pixel 101, and blue and red sub-pixel structures 213, 214 correspond to the pixel 102. In the embodiment of FIG. 2C, red and green sub-pixel structures 221, 222 correspond to the pixel 101, and blue and red sub-pixel structures 223, 224 correspond to the pixel 102. In FIG. 2D, green and red sub-pixel structures 231, 232 correspond to the pixel 101, and green and blue sub-pixel structures 233, 234 correspond to the pixel 102. In FIG. 2E, green and red sub-pixel structures 241, 242 correspond to the pixel 101, and green and blue sub-pixel structures 243, 244 correspond to the pixel 102. In FIG. 2F, red and green sub-pixel structures 251, 252 correspond to the pixel 101, and red and green sub-pixel structures 253, 254 correspond to the pixel 102. In some embodiments, two sub-pixel structures corresponding to the same pixel may be disposed on the same scan line or on two different scan lines, and/or disposed on the same data line or different data lines. People skilled in the technical field should be able to devise a display panel with other arrangements of sub-pixel structures, and the arrangement of the display panel 120 is not limited in the invention.

Figure 3:
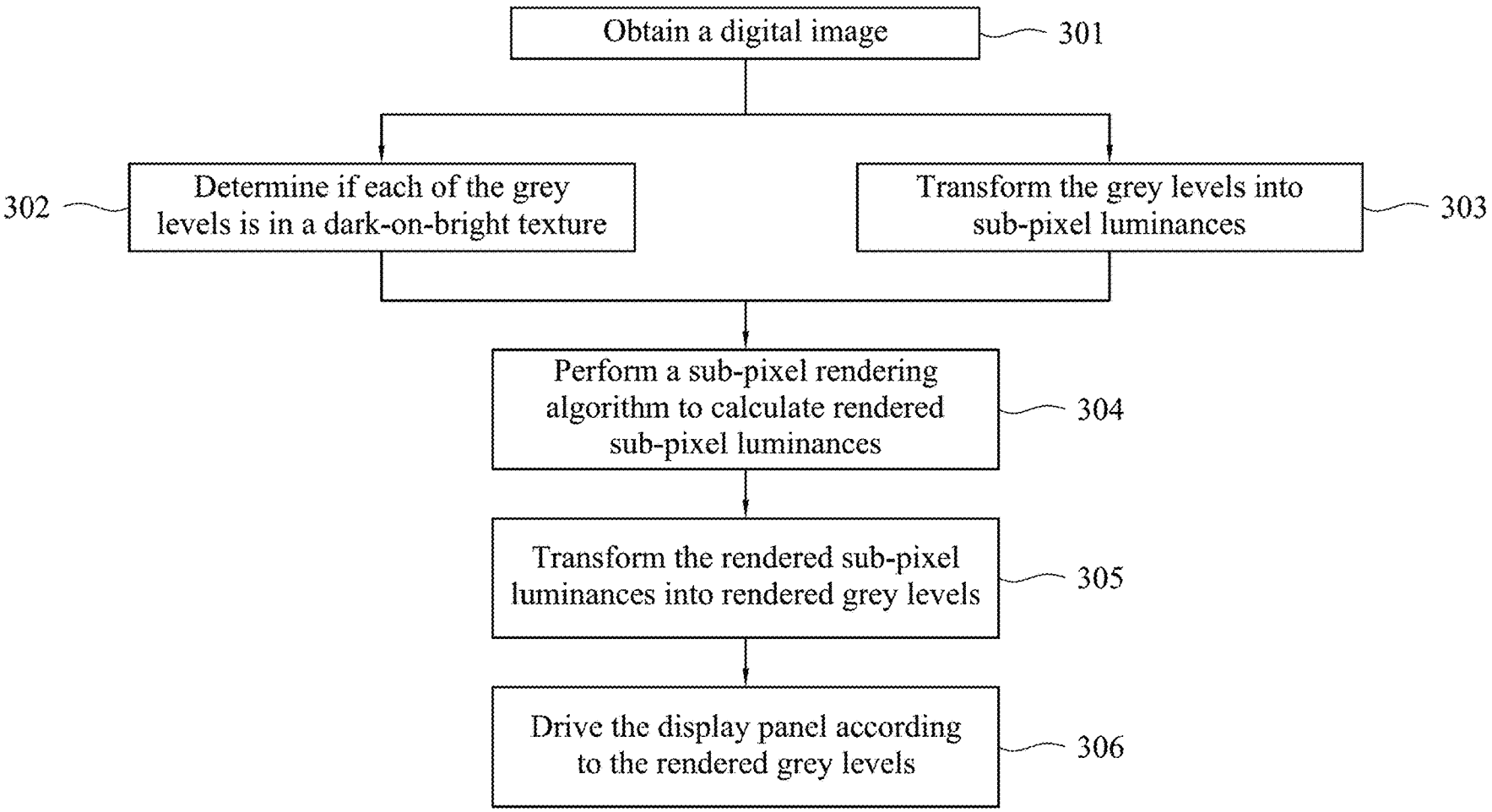
FIG. 3 is a flow chart of a sub-pixel rendering method in accordance with an embodiment.

When displaying the digital image in a conventional approach, three grey levels in one pixel are converted into two grey levels, so the displayed digital image may be blurred in a texture where black texts are shown in a white background because the while background are blended in the black text, resulting in lower contrast. A new sub-pixel rendering method is provided to address this issue. FIG. 3 is a flow chart of the sub-pixel rendering method in accordance with an embodiment. The method of FIG. 3 is performed by the computation circuit 110. In step 301, a digital image is obtained. As described above, the digital image has M rows and N columns of pixels, and each pixel includes 3 grey levels of red, green, and blue.

Figure 4:
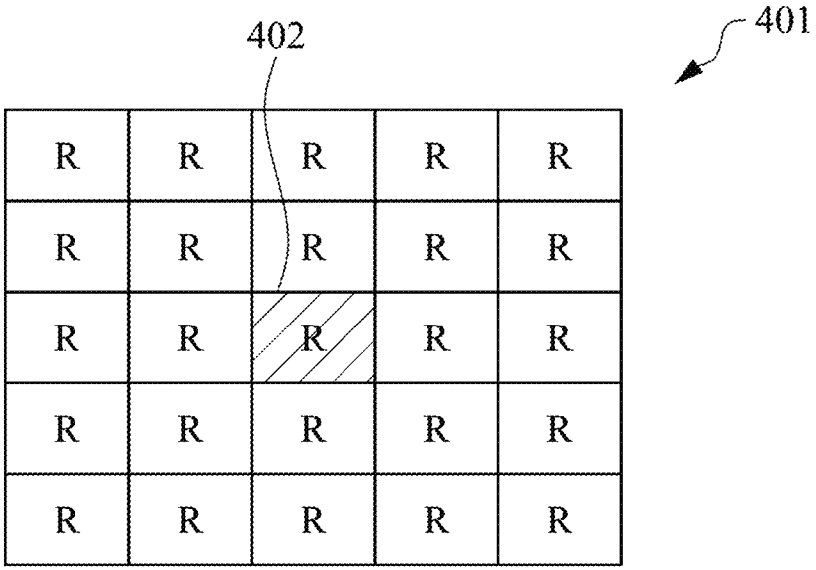
FIG. 4 is a schematic diagram of a texture mask in accordance with an embodiment.

In step 302, it is determined if each of the grey levels is in a dark-on-bright texture. The dark-on-bright texture indicates that relatively dark texts or lines are shown in a relatively bright background. A texture mask is applied to each of the grey levels in the step 302. FIG. 4 is a schematic diagram of a texture mask in accordance with an embodiment. Referring to FIG. 4, the size of a texture mask 401 is, for example but not limited to, 5×5. The currently processed grey level 402 locates at the center of the texture mask 401 where the grey level 402 is also referred to a center grey level. The texture mask 401 covers the grey level 402 and its neighboring grey levels, and these grey levels in the texture mask 401 have same colors such as red in the example of FIG. 4. The grey levels in the texture mask 401 are also referred to first grey levels. Next, it is determined how many first grey levels are dark grey levels. In some embodiments, the mean and the variance of the first grey levels are calculated. N times of the variance are subtracted from the mean as a first threshold where N is a positive real number (e.g. 2, 2.1, 3, etc.). The grey levels smaller than the first threshold are referred to the dark grey levels. If the number of the dark grey levels is less than a second threshold, then it is determined that the center grey level 402 is in a dark-on-bright texture. This determination is performed on each grey level of the digital image. Note that when the center grey level is green (or blue), then all grey levels in the texture mask 401 are green (or blue).

Other algorithms may be adopted in the step 302. In some embodiments, bright grey levels in the texture mask 401 are also determined, for example, by adding N times of the variance with the mean as a third threshold and referring the grey levels greater than the third threshold to the bright grey levels. When the number of the dark grey levels is less than the second threshold and the number of the bright grey levels is greater than a fourth threshold, then it is determined that the center grey level 402 is in the dark-on-bright texture. In some embodiments, when the number of the dark grey levels is in a predetermined range (e.g. 1-5) and the number of the bright grey levels is greater than the fourth threshold, then it is determined that the center grey level 402 is in the dark-on-bright texture. In some embodiments, it is determined that the center grey level 402 is in the dark-on-bright texture when one of the aforementioned conditions is satisfied and the center grey level 402 is the dark grey level. The first to fourth threshold may be set to have any values which are not limited in the invention.

Referring to FIG. 3, in step 303, the grey levels are transformed into sub-pixel luminances. In some embodiments, the step 303 is performed according to the gamma transformation which is written as the following equation (1).

$$L=I^{\alpha} \tag{1}$$

I is the grey level. L is the sub-pixel luminance. $\alpha$ is a real number such as 2.2, but the invention is not limited thereto. Note that all grey levels are transformed according to the equation (1), but different values of $\alpha$ are used for different colors. The sub-pixel luminances are used to perform a sub-pixel rendering algorithm in the following steps. If the sub-pixel rendering algorithm is performed according to the grey levels, a situation of color bleeding may occur because the grey levels do not represent real luminance.

Figure 5:
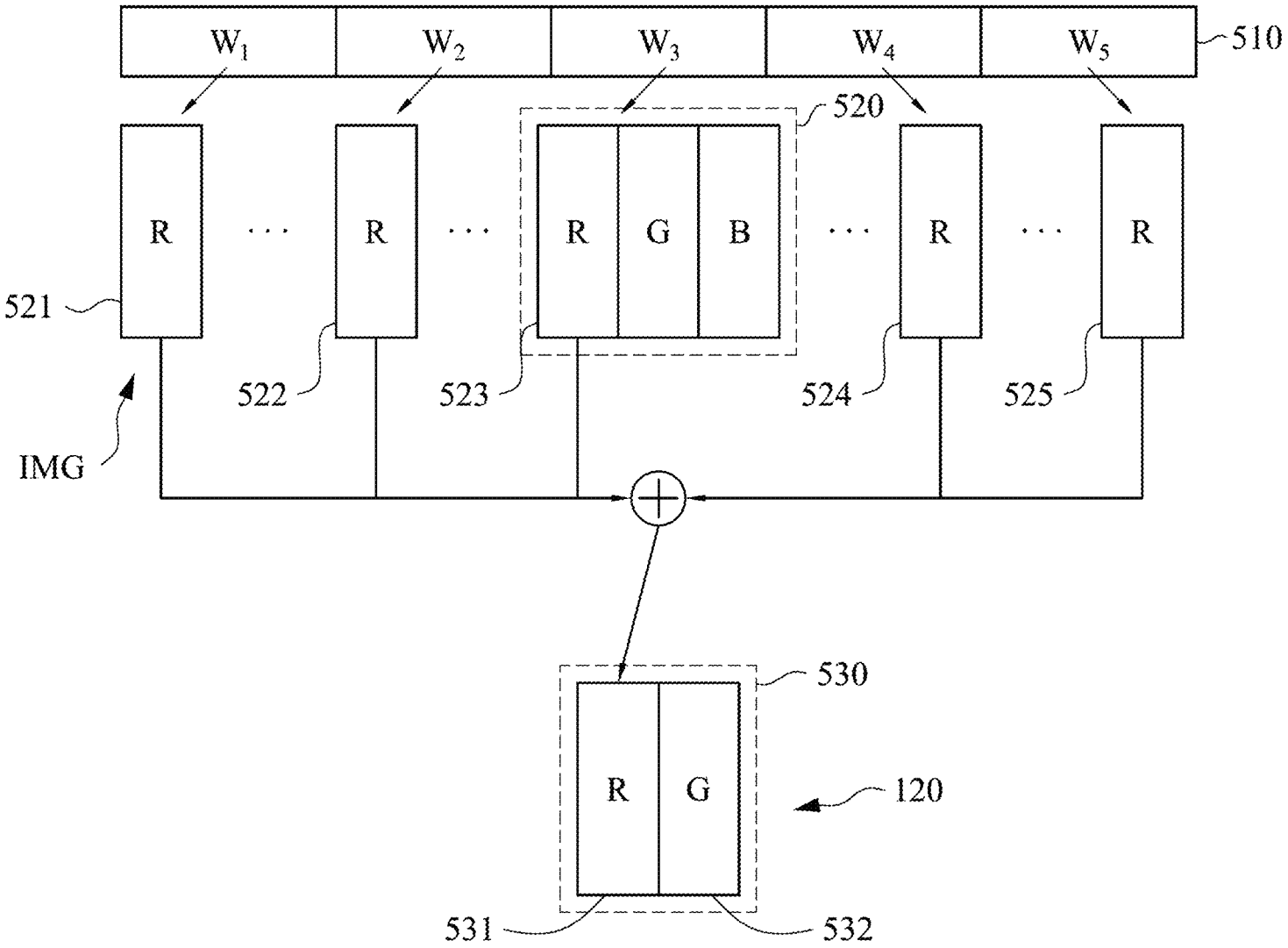
FIG. 5 is a schematic diagram of a filter operation in accordance with an embodiment.

In step 304, a sub-pixel rendering algorithm is performed to calculate rendered sub-pixel luminances. FIG. 5 is a schematic diagram of a filter operation in accordance with an embodiment. Referring to FIG. 5, a pixel 520 in the digital image IMG is the currently processed pixel. The pixel 520 corresponds to a pixel 530 on the display panel 120. Note that the pixel 520 has three sub-pixel luminances, but the pixel 530 has only two sub-pixel structures 531 and 532. A filter operation is performed to the sub-pixel luminances of the digital image IMG according to a rendering mask 510 to calculate the rendered sub-pixel luminances for the display panel 120. The size of the rendering mask 510 is, for example but not limited to, 1×5 with 5 weights $w_1$-$w_5$. Take the sub-pixel structure 531 as an example, the weights $w_1$-$w_5$ respectively correspond to sub-pixel luminances 521-525 in which the sub-pixel luminance 523 belong to the pixel 520, and the sub-pixel luminances 521, 522, 524 and 525 are the neighboring sub-pixel luminances in the same row of the digital image IMG. Note that the sub-pixel luminances 521-525 have same colors as the sub-pixel structure 531. In some embodiments, the sum of the weight $w_1$-$w_5$ is equal to 1. For example, $w_1=w_5=0.1$, $w_2=w_4=0.2$, and $w_3=0.4$, but the invention is not limited thereto.

In the embodiments, if any one of the sub-pixel luminances 521-525 is in the dark-on-bright texture, then the weight corresponds to this sub-pixel luminance is increased. For example, if the sub-pixel luminances 521, 523 are in the dark-on-bright texture, then the corresponding weights $w_1$, $w_3$ are altered into, for example, $w_1=0.2$, $w_3=0.5$. Next, the weights $w_1$-$w_5$ are normalized such that the sum of the weights $w_1$-$w_5$ is equal to 1. In some embodiments, the normalization is written as the following equation (2).

$$w'_i = \frac{w_i}{\sum_i w_i} \tag{2}$$

$w'_i$ is the normalized weight, and i is a positive integer in the range of i=1 . . . 5 in the embodiment. The normalized weighs $w'_1$-$w'_5$ are respectively multiplied by the sub-pixel luminances 521-525, then the products are summed up to obtain a rendered sub-pixel luminance for the sub-pixel structure 531. Similarly, the rendering mask 510 is applied to the green sub-pixel luminance of the pixel 520 and the neighboring green sub-pixel luminances to calculate a rendered sub-pixel luminance for the sub-pixel structure 532. This procedure is repeated until all pixels of the digital image are processed.

Referring to FIG. 3, in step 305, the rendered sub-pixel luminances are transformed into rendered grey levels. In some embodiments, The step 305 is performed according to the following equation (3) where L' is the rendered sub-pixel luminance and I' is the rendered grey level. Note that the number of the rendered grey levels is equal to the number of the sub-pixel structures in the display panel 120.

$$I' = (L')^{\frac{1}{\alpha}} \tag{3}$$

In step 306, the display panel 120 is driven according to the rendered grey levels. In some embodiments, the computation circuit 110 may transmit the rendered grey levels to a source driver (not shown) which transforms the rendered grey level into voltages and applies the voltages on the corresponding data lines. However, how the display panel is driven is not limited in the invention. Each step of FIG. 3 can be implemented as program codes or circuit, and other steps may be inserted between steps of FIG. 3.

Figure 6:
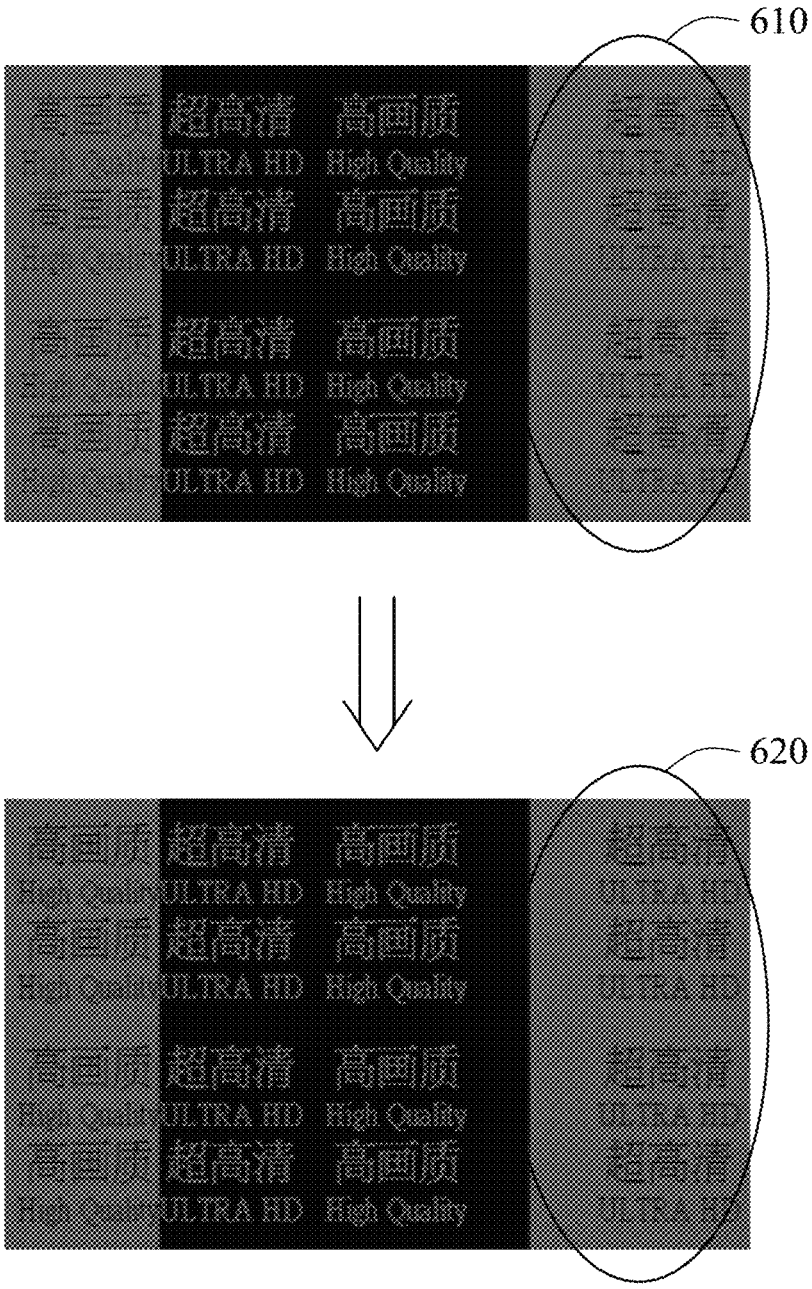
FIG. 6 is a diagram of experiment results in accordance with an embodiment.

FIG. 6 is a diagram of experiment results in accordance with an embodiment. Referring to FIG. 6, the upper image is the result of a conventional sub-pixel rendering method. In an area 610, black texts are shown in the white background. The lower image is the result of the sub-pixel rendering method of FIG. 3. The contrast in an area 620 is higher than that of the area 610 because the dark-on-bright texture is detected and the weights of the black texts are increased.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A sub-pixel rendering method for a display panel comprising a plurality of sub-pixel structures, wherein the sub-pixel rendering method comprises:

obtaining a digital image comprising a plurality of pixels, wherein each of the pixels comprises a plurality of grey levels, and each of the pixels corresponds to only two of the sub-pixel structures;

obtaining a plurality of first grey levels from the grey levels that have same colors according to a texture mask;

determining a number of the first grey levels that are smaller than a first threshold; and determining that a center grey level of the first grey levels in a texture mask is in a dark-on-bright texture if the number of the first grey levels that are smaller than the first threshold is less than a second threshold;

transforming the grey levels into a plurality of sub-pixel luminances;

performing a filter operation on the sub-pixel luminances according to a rendering mask to calculate a plurality of rendered sub-pixel luminances, wherein the rendering mask comprises a plurality of weights, each of the weights corresponds to one of the sub-pixel luminances, and one of the weights is increased if the corresponding sub-pixel luminance is in the dark-on-bright texture;

transforming the rendered sub-pixel luminances into a plurality of rendered grey levels, wherein a number of the rendered grey levels is equal to the number of the sub-pixel structures; and driving the display panel according to the rendered grey levels.

2. The sub-pixel rendering method of claim 1, further comprising:

calculating a mean and a variance of the first grey levels; and subtracting N times of the variance from the mean as the first threshold, wherein N is a positive real number.

3. The sub-pixel rendering method of claim 1, wherein the step of transforming the grey levels into the sub-pixel luminances comprises:

performing a gamma transformation to each of the grey levels to obtain a corresponding one of the sub-pixel luminances.

4. The sub-pixel rendering method of claim 1, wherein after the one of the weights is increased, the sub-pixel rendering method further comprises:

normalizing the weights of the rendering mask such that a sum of the weights is equal to 1.

5. The sub-pixel rendering method of claim 4, wherein the sub-pixel luminances corresponding to the rendering mask have same colors.

6. A display device comprising:

a display panel comprising a plurality of sub-pixel structures; and a computation circuit configured to obtain a digital image comprising a plurality of pixels, wherein each of the pixels comprises a plurality of grey levels, and each of the pixels corresponds to only two of the sub-pixel structures, wherein the computation circuit is further configured to:

obtain a plurality of first grey levels from the grey levels that have same colors according to a texture mask;

determine a number of the first grey levels that are smaller than a first threshold; and determine that a center grey level of the first grey levels in a texture mask is in a dark-on-bright texture if the number of the first grey levels that are smaller than the first threshold is less than a second threshold;

transform the grey levels into a plurality of sub-pixel luminances;

perform a filter operation on the sub-pixel luminances according to a rendering mask to calculate a plurality of rendered sub-pixel luminances, wherein the rendering mask comprises a plurality of weights, each of the weights corresponds to one of the sub-pixel luminances, and one of the weights is increased if the corresponding sub-pixel luminance is in the dark-on-bright texture;

transform the rendered sub-pixel luminances into a plurality of rendered grey levels, wherein a number of the rendered grey levels is equal to the number of the sub-pixel structures; and drive the display panel according to the rendered grey levels.

7. The display device of claim 6, wherein the computation circuit is further configured to:

calculate a mean and a variance of the first grey levels; and subtract N times of the variance from the mean as the first threshold, wherein N is a positive real number.

8. The display device of claim 6, wherein the computation circuit is further configured to:

perform a gamma transformation to each of the grey levels to obtain a corresponding one of the sub-pixel luminances.

9. The display device of claim 6, wherein the computation circuit is further configured to:

normalize the weights of the rendering mask such that a sum of the weights is equal to 1.

10. The display device of claim 9, wherein the sub-pixel luminances corresponding to the rendering mask have same colors.

* * * * *